US005647274A

United States Patent [19]

Yasuda et al.

[11] Patent Number: 5,647,274

[45] Date of Patent: Jul. 15, 1997

[54] PRESSURE PRINTING APPARATUS

[75] Inventors: Akira Yasuda; Hideaki Takayama; Masaharu Ogata, all of Tokyo, Japan

[73] Assignee: Riso Kagaku Corporation, Tokyo, Japan

[21] Appl. No.: 597,804

[22] Filed: Feb. 7, 1996

[30] Foreign Application Priority Data

Feb. 10, 1995 [JP] Japan ..... 7-022948

[51] Int. Cl.[6] ..... B05C 17/06; B41F 1/28

[52] U.S. Cl. ..... 101/126; 101/474

[58] Field of Search ..... 101/126, 114, 101/474, 407.1; 400/622, 624, 625, 632, 632.1; 118/500; 271/3, 4, 245

[56] References Cited

U.S. PATENT DOCUMENTS

| | | | |
|---|---|---|---|
| 1,999,959 | 4/1935 | Conus | 101/474 |
| 2,991,711 | 7/1961 | Ehrhard et al. | 101/176 |
| 4,440,387 | 4/1984 | Ikoma et al. | 271/245 |
| 4,696,228 | 9/1987 | David et al. | 101/126 |
| 5,245,922 | 9/1993 | Klemm | 101/126 |
| 5,337,662 | 8/1994 | Hasegawa | 101/126 |

FOREIGN PATENT DOCUMENTS

| | | |
|---|---|---|
| 0573257 | 12/1993 | European Pat. Off. . |
| 5330223 | 12/1993 | Japan . |

*Primary Examiner*—Eugene H. Eickholt

*Attorney, Agent, or Firm*—Sughrue, Mion, Zinn, Macpeak & seas

[57] ABSTRACT

A pressure printing apparatus in which a printing sheet is pressed against a stencil sheet, the pressure printing apparatus includes: a printing sheet table having a printing sheet holding surface inclined vertically; a sheet slidable member provided on the printing sheet holding surface of the printing sheet table, for sliding the printing sheet down from the printing sheet table; a gate for selectively holding the printing sheet fed onto the printing sheet holding surface of the printing sheet table on the printing sheet holding surface; a stencil sheet support portion disposed above and in opposition to the printing sheet table, for supporting the stencil sheet; a pressing member for pressing the printing sheet table against the stencil sheet support portion; and a printing sheet release frame provided between the printing sheet held by the printing sheet table and the stencil sheet supported by the stencil sheet support portion, for releasing the printing sheet stuck to the stencil sheet from the stencil sheet.

10 Claims, 6 Drawing Sheets

PRESSURE PRINTING APPARATUS

BACKGROUND OF THE INVENTION

The present invention relates to a pressure printing apparatus using a stencil sheet.

A pressure printing apparatus using a plate-like stencil sheet has been described in Japanese Patent Application Laid-open No. Hei. 5-330223. The pressure printing apparatus has a printing sheet table inclined vertically and having an adhesive upper surface. A stencil sheet support member on which a stencil sheet is to be mounted is disposed above the printing sheet table so as to be opposite to the printing sheet table. The printing sheet table can be moved up and down relative to the stencil sheet support member. The printing sheet table has a releasing means. The releasing means can project upward from the upper surface on which a printing sheet is stuck to thereby release the printing sheet from the printing sheet table.

When a printing sheet is fed from the upper edge side of the printing sheet table to the upper surface thereof, the printing sheet table moves toward the stencil sheet support member. The printing sheet is pressed against a stencil sheet so that the stencil printing is performed. After printing, the printing sheet table is separated from the stencil sheet support member and the printing sheet subjected to printing is separated from the stencil sheet in a state that the printing sheet is stuck to an adhesive portion of the printing sheet table. When the printing sheet table goes back to a stand-by position, the releasing means projects upward from the upper surface of the printing sheet table so that the printing sheet is released from the adhesive upper surface of the printing sheet table. The printing sheet released from the printing sheet table is slid down on the upper surface of the releasing means by its own weight and ejected from an outlet provided below the printing sheet table.

In the aforementioned pressure printing apparatus, it is required to provide a releasing means which can make frequent appearances on the upper surface of the printing sheet table so that not only a printing sheet stuck to the adhesive portion of the printing sheet table can be separated after printing but also the printing sheet thus separated can be slid down on the printing sheet table. The mechanism for achieving such functions is so complex as to make it difficult to attain reduction in size and weight of the aforementioned pressure printing apparatus.

SUMMARY OF THE INVENTION

An object of the present invention is to provide a pressure printing apparatus in which release and ejection of printing sheet from stencil sheet can be performed securely by a simple mechanism in pressure printing using stencil sheet.

According to the first aspect of the present invention, the foregoing object is achieved by a pressure printing apparatus comprising: a printing sheet table having a printing sheet holding surface inclined vertically; sheet slidable means provided on the printing sheet holding surface of the printing sheet table, for sliding a printing sheet down from the printing sheet table; holding means for selectively holding the printing sheet fed onto the printing sheet holding surface of the printing sheet table on the printing sheet holding surface; a stencil sheet support portion disposed above and in opposition to the printing sheet table, for supporting a stencil sheet; pressing means for pressing the printing sheet table against the stencil sheet support portion; and releasing means provided between the printing sheet held by the printing sheet table and the stencil sheet supported by the stencil sheet support portion, for releasing the printing sheet stuck to the stencil sheet from the stencil sheet.

According to the second aspect of the invention, there is provided the pressure printing apparatus of the first aspect, wherein the sheet slidable means includes a high-molecular molding member.

According to the third aspect of the invention, there is provided the pressure printing apparatus according to the second aspect, wherein the high-molecular molding member is made of a high-molecular film sheet.

According to the fourth aspect of the invention, there is provided the pressure printing apparatus according to the first aspect, wherein an angle of slide on the printing sheet holding surface of the printing sheet table is not larger than 45°.

According to the fifth aspect of the invention, there is provided the pressure printing apparatus according to the first aspect, wherein value of surface resistance on the printing sheet holding surface of the printing sheet table is not larger than $10^8$ Ω.

According to the sixth aspect of the invention, there is provided the pressure printing apparatus according to the first aspect, wherein the sheet slidable means includes an uneven surface formed on the holding surface of the printing sheet table to reduce an area of contact between the holding surface and the printing sheet.

According to the seventh aspect of the invention, there is provided the pressure printing apparatus according to the first aspect, wherein the printing sheet table includes an elastic body which keeps a state of constant pressure within a predetermined displacement range.

A printing sheet is fed to the holding surface of the printing sheet table and held thereon by the holding means. the pressing means moves the printing sheet table toward the stencil sheet support portion and presses the printing sheet against a stencil sheet to thereby perform stencil printing. The printing sheet table is separated from the stencil sheet support portion and the printing sheet stuck to the stencil sheet is released from the stencil sheet by the releasing means. If the holding of printing sheet by the holding means is released, the printing sheet thus released is slid down on the printing sheet table smoothly by a sheet slidable means provided on the holding surface of the printing sheet table and is drawn out of the printing sheet table.

DETAILED DESCRIPTION OF THE PREFERRED EMBODIMENTS

Figure 1:
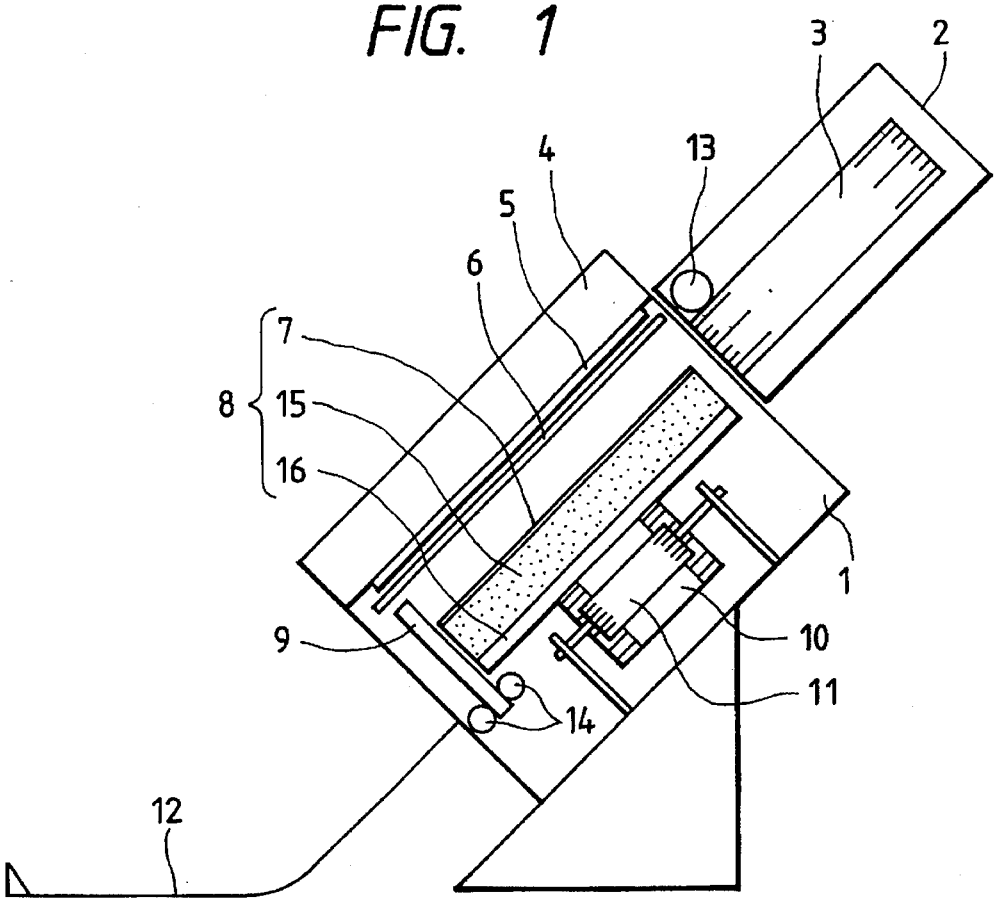
FIG. 1 is a perspective view typically showing the internal structure of a pressure printing apparatus according to a first embodiment of the present invention.

A pressure printing apparatus as a first embodiment of the present invention will be described below with reference to FIGS. 1 to 3.

The pressure printing apparatus 1 has a stencil sheet support 4 serving as a stencil sheet support portion. The stencil sheet support 4 is designed so that a surface for mounting a stencil sheet 5 thereon is inclined downward. Thus, the stencil sheet 5 mounted on the stencil sheet support 4 is inclined at about 45° with respect to a horizontal plane so as to look obliquely downward.

A printing sheet table 8 is provided so as to face the stencil sheet support 4. The printing sheet table 8 has a sheet slidable member 7 which acts as a sheet slidable means constituting a printing sheet 3 holding surface, a pad 15 which is an elastic body provided on the lower surface of the sheet slidable member 7, and a pedestal 16 provided on the lower surface of the pad 15. A sheet of printing sheet 3 fed onto the upper surface of the sheet slidable member 7 of the printing sheet table 8 is held in a posture in which the printing sheet 3 is inclined at about 45° with respect to a horizontal plane, so that the printing sheet 3 parallel faces the stencil sheet 5 supported by the stencil sheet support 4 located in an oblique upward position.

In this embodiment, the sheet slidable member 7 is made from a high-molecular molding and, specifically, made from a high-molecular film sheet. The upper surface of the sheet slidable member 7 serving as a printing sheet holding surface has such characteristics that the angle of slide is not larger than 45°, and the value of surface resistance is not larger than $10^8$ Ω.

Figure 7:
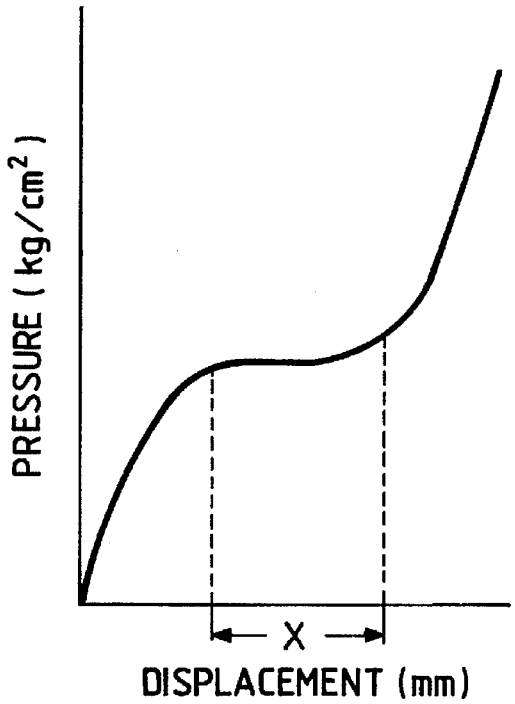
FIG. 7 is a characteristic graph showing the relation between the value of pressure and the quantity of displacement in a pad as an elastic body used in the respective embodiments of the present invention.
Figure 8:
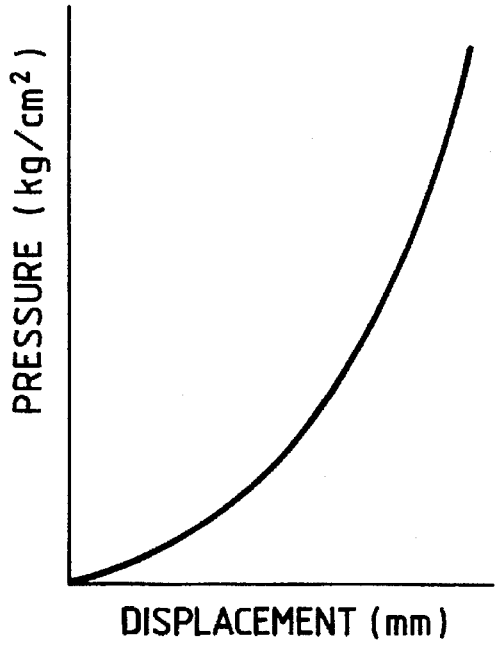
FIG. 8 is a characteristic graph showing the relation between the value of pressure and the quantity of displacement in a pad as an elastic body used generally in the conventional case.

The pad 15 is made from soft polyurethane foam. As shown in FIG. 7, the pad 15 has such a characteristic that the state of pressure is kept nearly constant when the quantity of displacement is within a predetermined range X. In the case of ordinary soft polyurethane foam, printing density varies when the pressing force of an operator changes, because the value of pressure increases as the quantity of displacement increases as shown in FIG. 8. In the case of the pad 15 employed in the printing sheet table 8 in the pressure printing apparatus of this embodiment, however, printing density can be kept constant regardless of the change of the pressing force of the operator, because printing pressure can be kept nearly constant when the quantity of displacement of the pad 15 is within the aforementioned predetermined range X.

The printing sheet table 8 can be moved up and down along a direction perpendicular to the surface of the sheet slidable member 7 by a pressing means so that the printing sheet 3 can be pressed against the stencil sheet 5 supported by the stencil sheet support 4. The pressing means has a rack 10 fixed to the lower surface of the pedestal 16 of the printing sheet table 8, a gear 11 engaged with the rack 10, and a drive means, not shown, for driving the gear 11.

A gate 9 serving as a printing sheet holding means is provided near the lower edge of the printing sheet table 8. The gate 9 is made from a plate-like member and provided so as to be moved by gate moving rollers 14 in a direction parallel to the direction of movement of the printing sheet table 8. The lower edge of the printing sheet 3 supplied onto the sheet slidable member 7 is stopped by the gate 9 if the gate 9 projects upward from the surface of the sheet slidable member 7 when the printing sheet table 8 is in a position where the printing sheet 3 is allowed to be accepted, so that the printing sheet 3 is held on the printing sheet table 8. If the gate 9 is moved down from the surface of the sheet slidable member 7 when the printing sheet table 8 is in this position, the printing sheet 3 held on the printing sheet table 8 is slid down.

A printing sheet release frame 6 serving as a releasing means by which the printing sheet 3 stuck to the stencil sheet 5 is released from the stencil sheet, is provided between the printing sheet table 8 and the stencil sheet support 4. As shown in FIGS. 2 and 3, the printing sheet release frame 6 has lock portions for locking at least two sides of the sheet of printing sheet 3. Further, the printing sheet release frame 6 is guided by guide means 17*a* and 17*b* so that the printing sheet release frame 6 can move along the direction of movement of the printing sheet table 8.

A printing sheet feeding portion 2 is disposed obliquely upward with respect to the printing sheet table 8 and the stencil sheet support 4. Pieces of the printing sheet 3 stacked in the printing sheet feeding portion 2 are fed by a paper feeding roller 13 one by one obliquely downward onto the surface of the sheet slidable member 7 of the printing sheet table 8.

A printing sheet receptacle 12 is provided below the printing sheet table 8. After printing, pieces of the printing sheet 3 slid down out of the printing sheet table 8 are received in the printing sheet receptacle 12.

In the pressure printing apparatus 1 configured as described above, pieces of printing sheet 3 housed in the printing sheet feeding portion 2 are fed one by one by the paper feeding roller 13 onto the printing sheet table 8. In this occasion, the printing sheet release frame 6 is positioned by an urging member not shown so as to be far from the printing sheet table 8. Further, the gate 9 is positioned so as to project upward from the surface of the sheet slidable member 7. A printing sheet 3 fed onto the printing sheet table 8 is held on the surface of the sheet slidable member 7 because the lower end portion of the printing sheet is stopped by the gate 9.

The gear 11 is driven by the drive means not shown, so that the printing sheet table 8 integrated with the rack 10 is pressed up toward the stencil sheet 5. The printing sheet 3 mounted on the printing sheet table 8 is pressed against the stencil sheet 5 through the printing sheet release frame 6, so that a stencil printing image is formed on the printing sheet 3.

Figure 2:
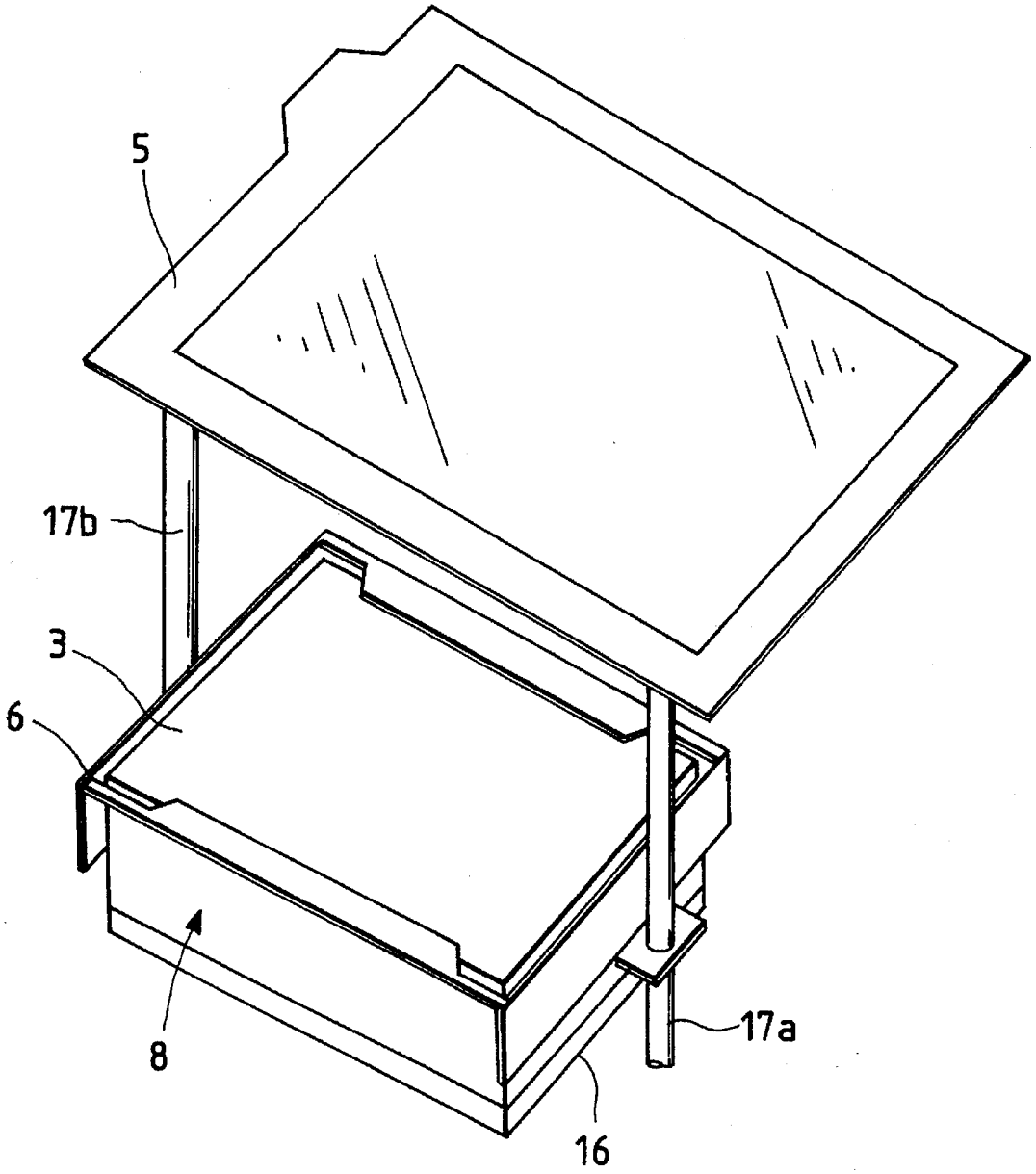
FIG. 2 is a partly perspective view showing an action of releasing a printing sheet from a stencil sheet in the pressure printing apparatus according to the first embodiment of the present invention.

As shown in FIG. 2, the printing sheet release frame 6, the printing sheet 3 and the printing sheet table 8 are collectively moved so as to be separated from the stencil sheet 5. The printing sheet 3 is released from the stencil sheet 5 by the printing sheet release frame 6.

Figure 3:
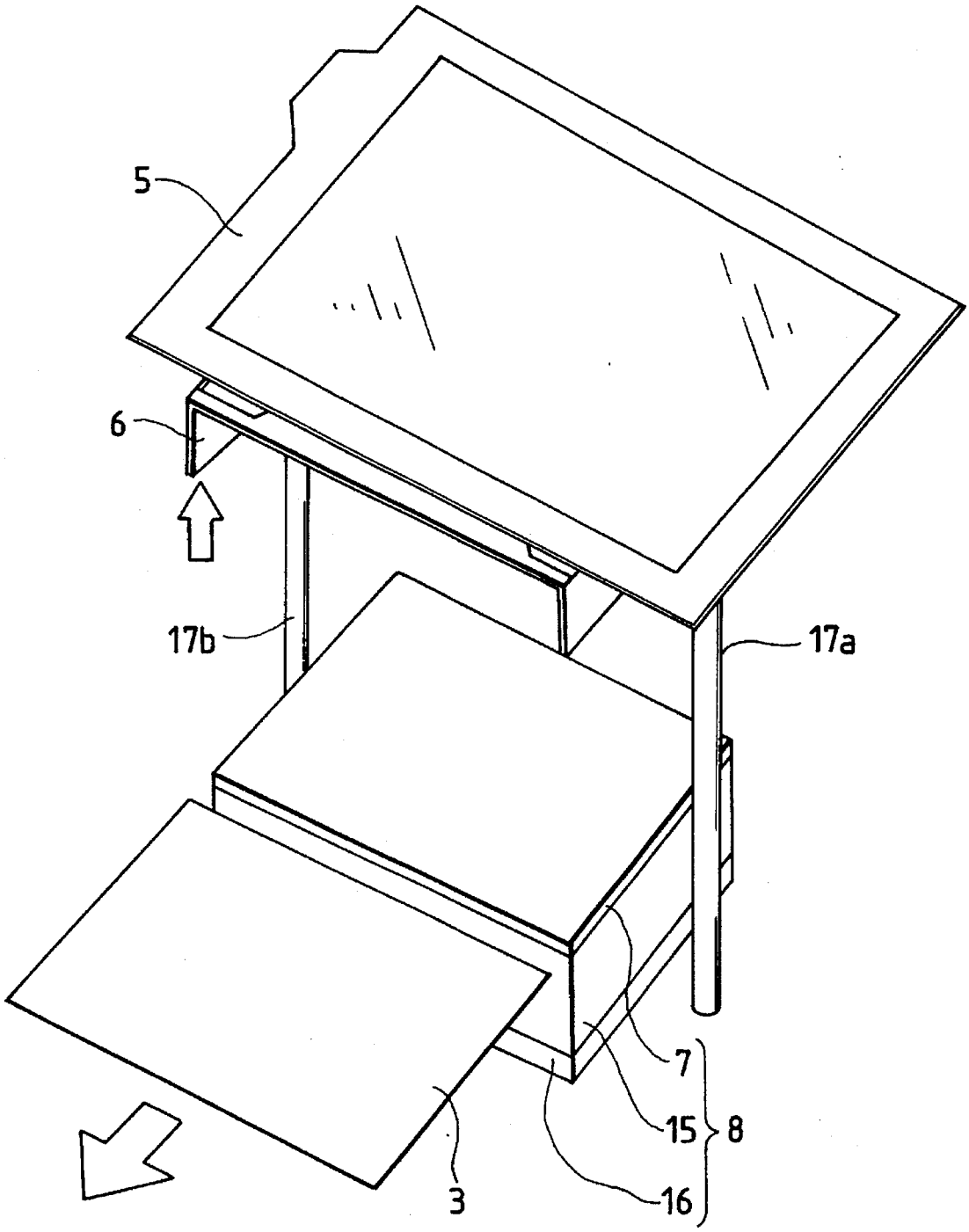
FIG. 3 is a partly perspective view showing an action of sliding a printing sheet out of a printing sheet table in the pressure printing apparatus according to the first embodiment of the present invention.

When the printing sheet table 8 returns to its initial position, as shown in FIG. 3, the printing sheet release frame 6 is pressed up toward the stencil sheet 5 along the guide means 17*a* and 17*b* by the urging means not shown and is separated from the printing sheet table 8. The printing sheet 3 is slid down by its own weight on the sheet slidable member 7 stuck to the whole upper surface of the pad 15 in the printing sheet table 8. When the gate 9 is moved down so as to be lower than the surface of the sheet slidable member 7, the printing sheet 3 is ejected from the printing sheet outlet into the printing sheet receptacle 12.

Figure 6:
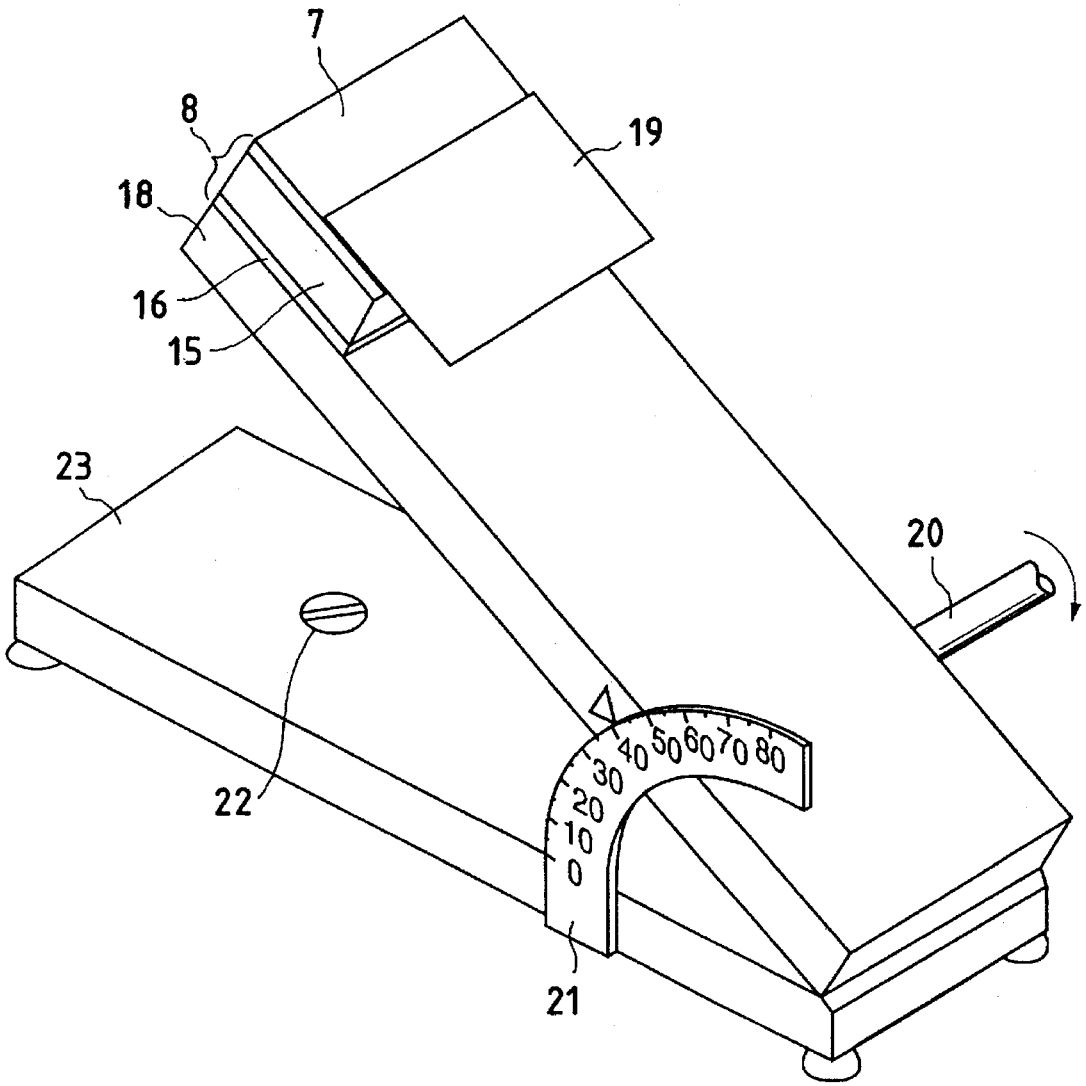
FIG. 6 is a perspective view showing an example of a slide angle measurement apparatus.

Referring next to FIG. 6, the way of obtaining the angle of slide in the sheet slidable member 7 will be described.

While the horizon is confirmed by a spirit level 22 mounted into a fixing platform 23, the printing sheet table 8 having a width of 148.0 mm, a length of 100.0 mm and a thickness of 20.0 mm is fixed to an inclination platform 18. In the condition in which the angle of inclination in the inclination platform 18 is adjusted to 0° after an official postcard 19 is put on the sheet slidable member 7, a lever 20 is driven at a constant speed (not higher than 3.0° per second) to increase the inclination angle of the inclination platform 18. At the point of time when the official postcard 19 begins to slide, the angle of inclination is read by a protractor 21. The aforementioned measurement operation is repeated by five times or more with respect to one sheet slidable member, so that the maximum value of the inclination angle is regarded as the angle of slide in the sheet slidable member 7.

Figure 4:
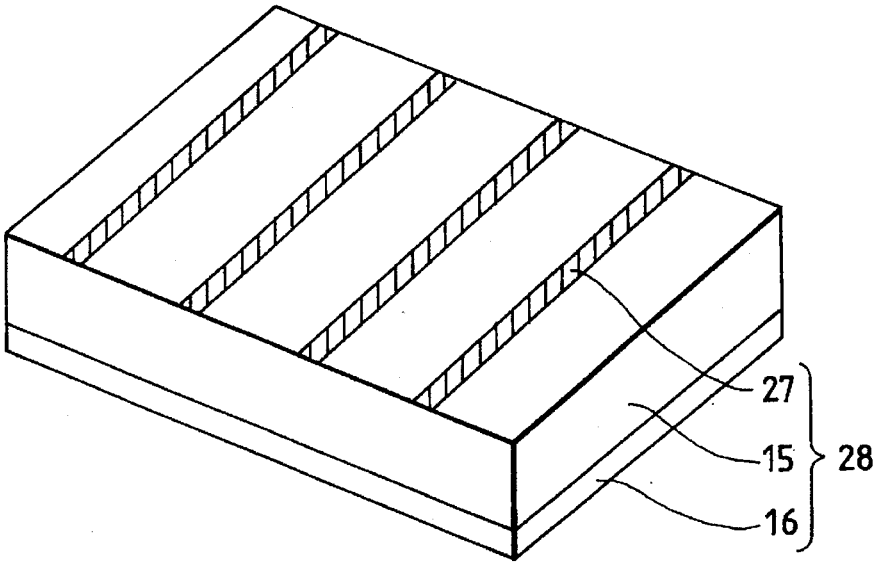
FIG. 4 is a perspective view showing a printing sheet table in a pressure printing apparatus according to a second embodiment of the present invention.

Although the first embodiment has shown the case where the sheet slidable member 7 of a high-molecular molding, or the like, constituting a holding surface of the printing sheet table 8 is provided on the whole upper surface of the printing sheet table 8, the present invention can be applied to the case where a plurality of belt-like sheet slidable members 27 are provided at intervals of a predetermined distance as shown in FIG. 4 which is a view of a printing sheet table 28 as a second embodiment of the present invention. Incidentally, the configuration of the second embodiment is the same as that of the first embodiment except parts shown in FIG. 4.

Figure 5A:
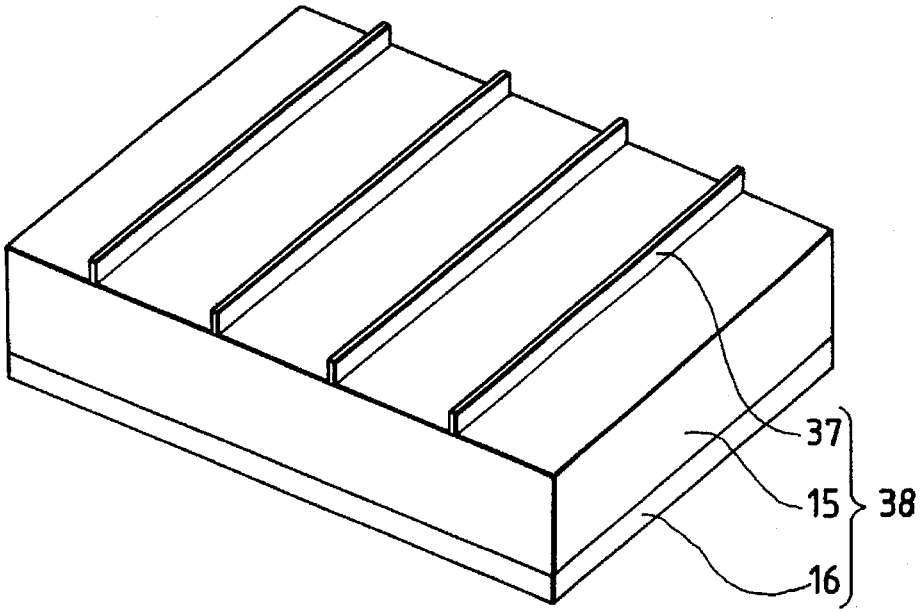
FIGS. 5(*a*) and 5(*b*) are perspective views showing a printing sheet table in a pressure printing apparatus according to a third embodiment of the present invention.
Figure 5B:
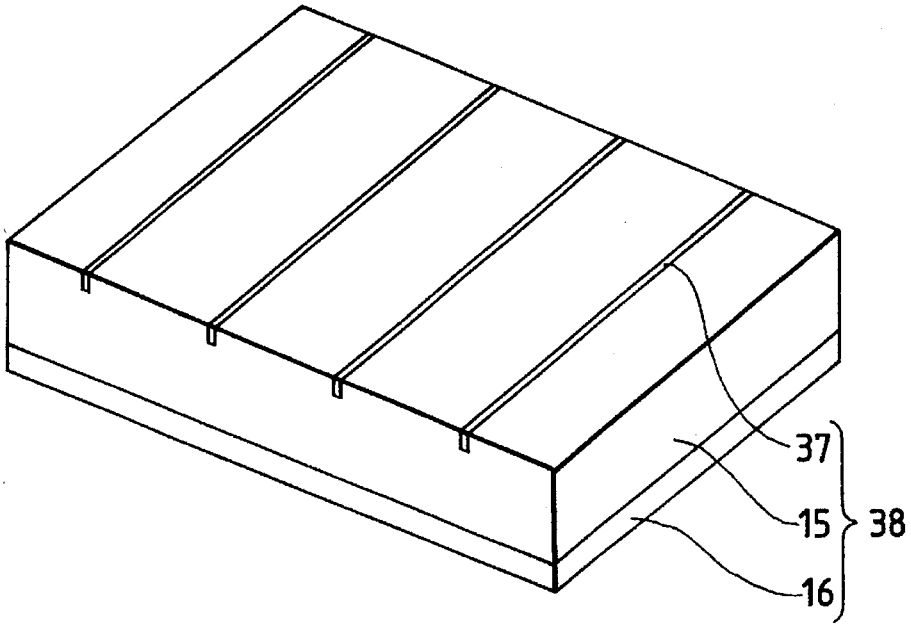

Alternatively, a plurality of resin ribs 37 as sheet slidable members may be provided on the holding surface as shown in FIG. 5(*a*) which is a view of a printing sheet table 38 as a third embodiment of the present invention, so that the ribs 37 can be buried in the pad 15 when force acts on the ribs 37 as shown in FIG. 5(*b*). Incidentally, the configuration of the third embodiment is the same as that of the first embodiment except parts shown in FIGS. 5(*a*) and 5(*b*).

In the respective embodiments which have been described above, sheet slidable members separated from the pad which is a body of the printing sheet table are employed as a sheet slidable means provided on the holding surface of the printing sheet table. It is, however, unnecessary that the sheet slidable means is provided so as to be separate from the body of the printing sheet table. For example, the holding surface of the printing sheet table may be treated to form uneven to thereby reduce the area of contact between the printing sheet table and the printing sheet.

As described above, in the pressure printing apparatus according to the present invention, at least one part of the surface of the printing sheet table is smoothed so that a printing sheet released from a stencil sheet can be drawn out of the apparatus securely after printing without the provision of any complex printing sheet ejecting mechanism on the printing sheet table as in the conventional case. Accordingly, the pressure printing apparatus can be simplified in structure, so that the size and weight of the apparatus can be reduced.

What is claimed is:

1. A pressure printing apparatus in which a printing sheet is pressed against a stencil sheet, said pressure printing apparatus comprising:

a printing sheet table having a printing sheet holding surface inclined vertically;

sheet slidable means provided on said printing sheet holding surface of said printing sheet table, for sliding the printing sheet down from said printing sheet table;

holding means for selectively holding the printing sheet fed onto said printing sheet holding surface of said printing sheet table on said printing sheet holding surface;

a stencil sheet support portion disposed above and in opposition to said printing sheet table, for supporting stencil sheet;

pressing means for pressing said printing sheet table against said stencil sheet support portion; and releasing means provided between the printing sheet held by said printing sheet table and the stencil sheet supported by said stencil sheet support portion, for releasing the printing sheet stuck to the stencil sheet from the stencil sheet.

2. A pressure printing apparatus according to claim 1, wherein said sheet slidable means includes a high-molecular molding member.

3. A pressure printing apparatus according to claim 2, wherein said high-molecular molding member is made of a high-molecular film sheet.

4. A pressure printing apparatus according to claim 2, wherein said high-molecular molding member is attached whole of said printing sheet holding surface.

5. A pressure printing apparatus according to claim 2, wherein said high-molecular molding member is shaped as a plurality of belts attached on said printing sheet holding surface.

6. A pressure printing apparatus according to claim 1, wherein an angle of slide on said printing sheet holding surface of said printing sheet table is not larger than 45°.

7. A pressure printing apparatus according to claim 1, wherein value of surface resistance on said printing sheet holding surface of said printing sheet table is not larger than $10^8$ Ω.

8. A pressure printing apparatus according to claim 1, wherein said sheet slidable means includes an uneven surface formed on said holding surface of said printing sheet table to reduce an area of contact between said holding surface and said printing sheet.

9. A pressure printing apparatus according to claim 1, wherein said printing sheet table includes an elastic body which keeps a state of constant pressure within a predetermined displacement range.

10. A pressure printing apparatus according to claim 1, wherein said releasing means includes a printing sheet release frame movable with respect to both said printing sheet table and said stencil sheet support portion.

* * * * *